US011117392B2

(12) United States Patent
Mezaki

(10) Patent No.: US 11,117,392 B2
(45) Date of Patent: Sep. 14, 2021

(54) EJECTING APPARATUS, IMAGE FORMING APPARATUS, CURING METHOD UTILIZING IRRADEATING BLOCKS AND COMPUTER-READABLE MEDIUM

(71) Applicant: Daisuke Mezaki, Kanagawa (JP)

(72) Inventor: Daisuke Mezaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/650,829

(22) PCT Filed: Oct. 3, 2018

(86) PCT No.: PCT/JP2018/037123
§ 371 (c)(1),
(2) Date: Mar. 25, 2020

(87) PCT Pub. No.: WO2019/070008
PCT Pub. Date: Apr. 11, 2019

(65) Prior Publication Data

US 2020/0276833 A1 Sep. 3, 2020

(30) Foreign Application Priority Data

Oct. 6, 2017 (JP) ..... JP2017-195962
Sep. 3, 2018 (JP) ..... JP2018-164754

(51) Int. Cl.
*B41J 11/00* (2006.01)

(52) U.S. Cl.
CPC ..... *B41J 11/002* (2013.01)

(58) Field of Classification Search
CPC ..... B41J 11/002; B41J 11/00214; B41J 11/00218; B41J 2/2114
See application file for complete search history.

(56) References Cited

U.S. PATENT DOCUMENTS 9,375,951 B2 6/2016 Tsuchiya
2010/0289860 A1 11/2010 Takezawa et al.
(Continued)

FOREIGN PATENT DOCUMENTS

CN 102858542 A 1/2013
CN 103459156 A 12/2013
(Continued)

OTHER PUBLICATIONS

Chinese Office Action; Application 201880064309.3; dated Mar. 1, 2021.
References sheet(s) attached @ Additional.

*Primary Examiner* — Bradley W Thies
(74) *Attorney, Agent, or Firm* — Duft & Bornsen, PC

(57) ABSTRACT

An ejecting apparatus includes an ejection control unit configured to cause a first ejecting unit among ejecting units (301) configured to move in a main-scanning direction, to eject a liquid; an irradiating unit (400) divided into a plurality of irradiating blocks (401) in a sub-scanning direction; an irradiation control unit configured to turn off an irradiating block corresponding to the first ejecting unit. A first distance (Y) between a downstream end of the first ejecting unit in the sub-scanning direction and an upstream end of an irradiating block is larger than a second distance (C) by which the irradiating block irradiates a recording medium outside from an end of an emission surface of the irradiator block in the sub-scanning direction. The irradiation control unit is configured to cure the liquid by causing the irradiating block positioned downstream of the turned-off irradiating block corresponding to the first ejecting unit, to emit the activation energy ray.

11 Claims, 12 Drawing Sheets

(56) References Cited

U.S. PATENT DOCUMENTS

| | | | | |
|---|---|---|---|---|
| 2011/0235069 | A1 | 9/2011 | Otsuka et al. | |
| 2012/0120168 | A1 | 5/2012 | Kachi et al. | |
| 2012/0281049 | A1 | 11/2012 | Kachi | |
| 2012/0327147 | A1 | 12/2012 | Okawa et al. | |
| 2013/0235135 | A1* | 9/2013 | Kondo | B41J 11/00212 347/102 |
| 2013/0271541 | A1 | 10/2013 | Ohkawa et al. | |
| 2013/0293609 | A1* | 11/2013 | Ohkawa | B41J 2/01 347/9 |
| 2014/0002560 | A1 | 1/2014 | Ohkawa et al. | |
| 2014/0043386 | A1 | 2/2014 | Saita | |
| 2014/0073386 | A1 | 3/2014 | Aoki et al. | |
| 2015/0224793 | A1* | 8/2015 | Tsuchiya | B41J 11/002 347/16 |
| 2016/0152043 | A1 | 6/2016 | Mezaki | |
| 2017/0072706 | A1* | 3/2017 | Okawa | B41J 2/01 |
| 2017/0080720 | A1 | 3/2017 | Mezaki | |
| 2018/0207956 | A1 | 7/2018 | Mezaki | |

FOREIGN PATENT DOCUMENTS

| | | | |
|---|---|---|---|
| CN | 103596762 | A | 2/2014 |
| CN | 104640707 | A | 5/2015 |
| CN | 103269861 | B | 4/2016 |
| JP | 5047918 | | 10/2012 |
| JP | 2013028011 | A | 2/2013 |
| JP | 2013-176969 | | 9/2013 |
| JP | 5361842 | | 12/2013 |
| JP | 5421323 | | 2/2014 |
| JP | 5653818 | | 1/2015 |
| JP | 5665481 | | 2/2015 |
| JP | 5702191 | | 4/2015 |
| JP | 2015-186918 | | 10/2015 |
| JP | 5970874 | | 8/2016 |
| JP | 6145371 | | 6/2017 |
| WO | 2010/061904 | | 6/2010 |
| WO | 2012/053647 | | 4/2012 |
| WO | 2012/053648 | | 4/2012 |

* cited by examiner

[Fig. 1]
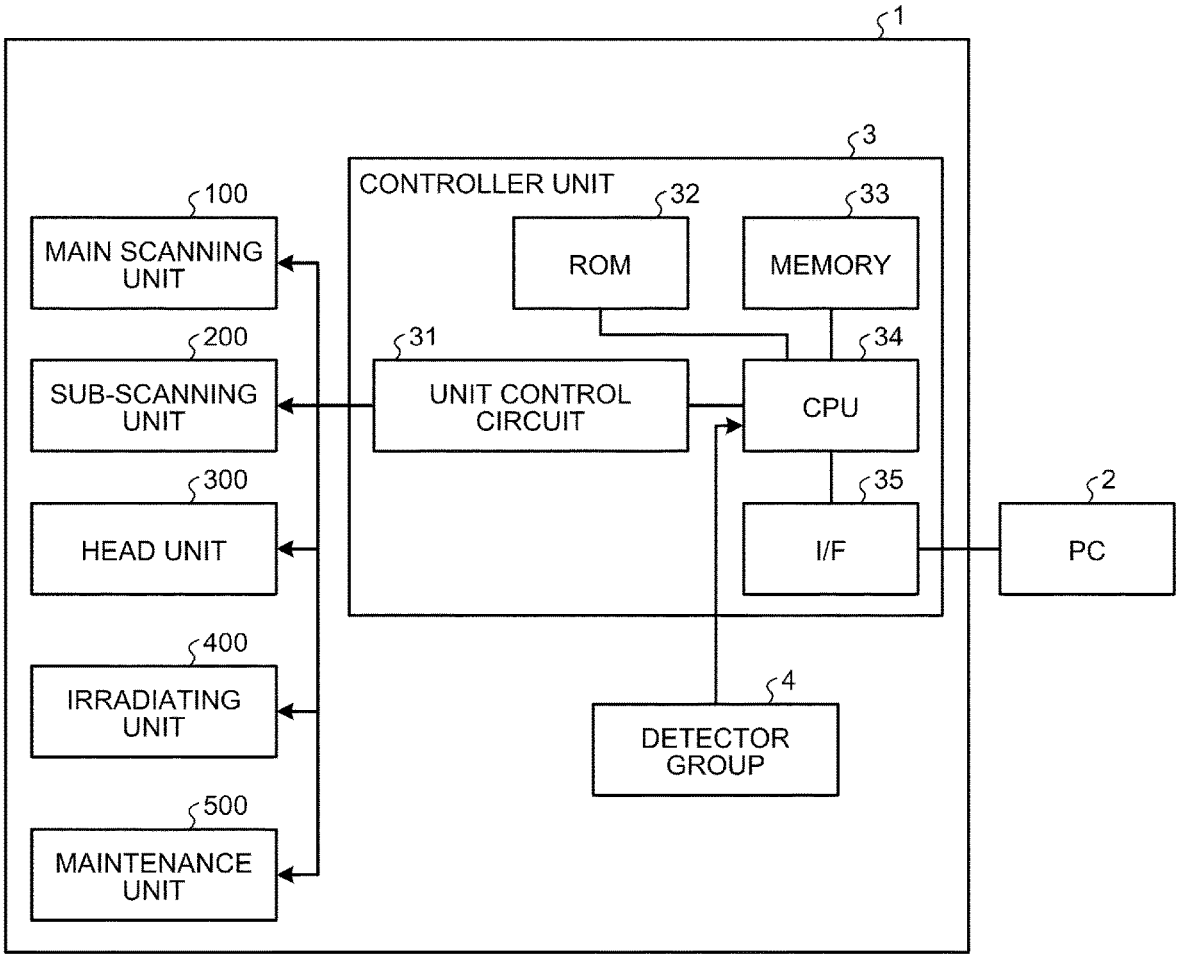
[Fig. 2]
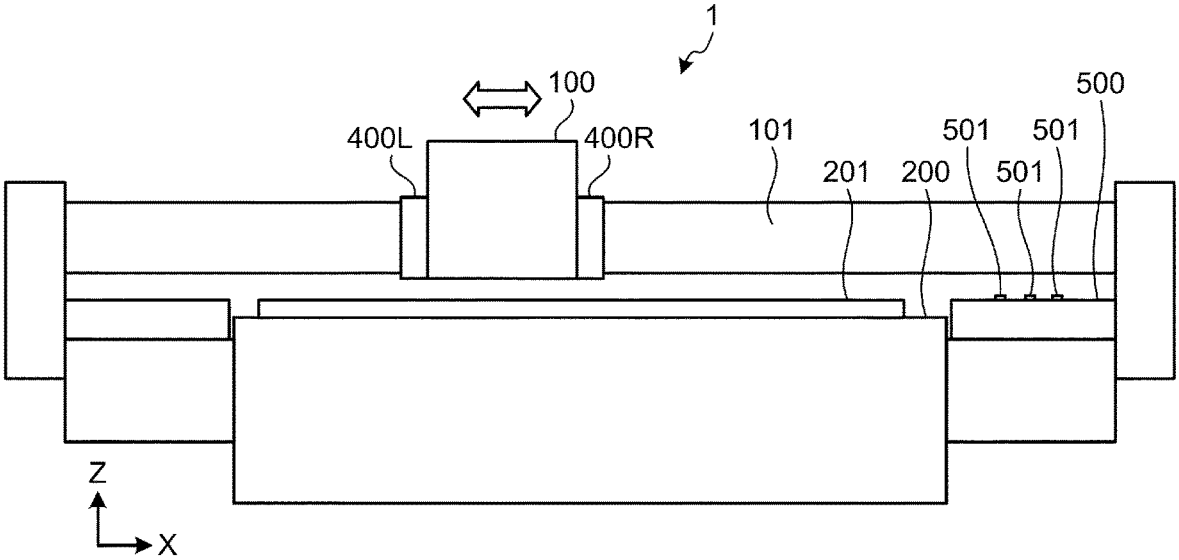

[Fig. 3]
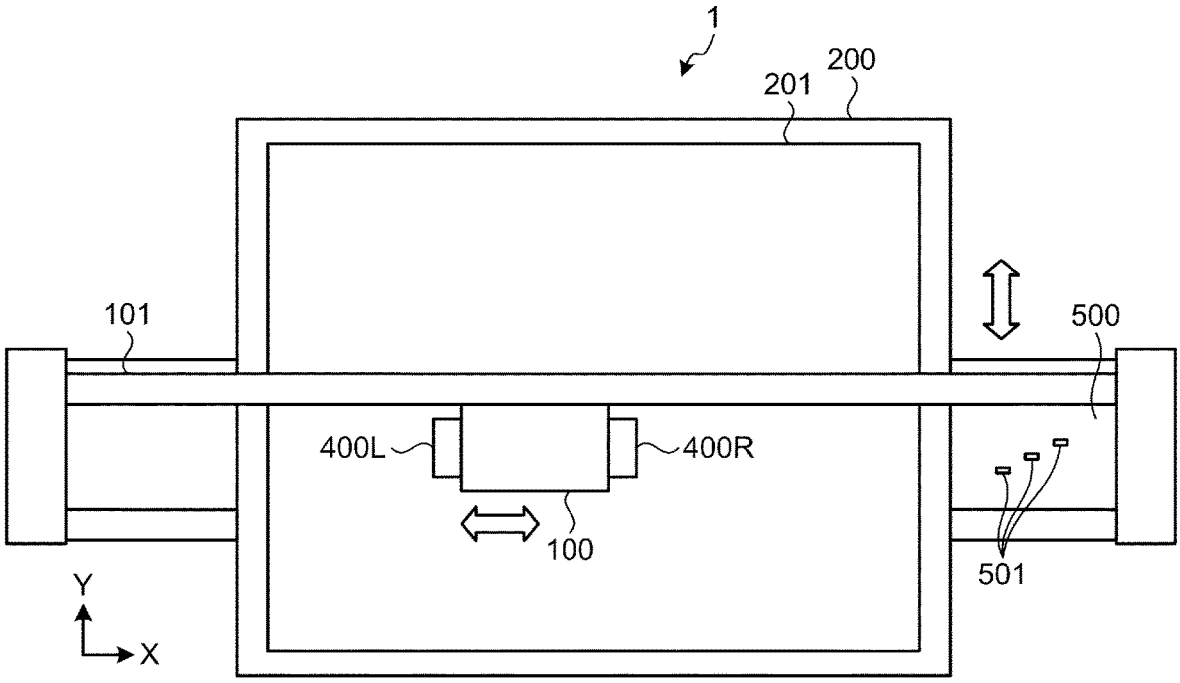

[Fig. 4]
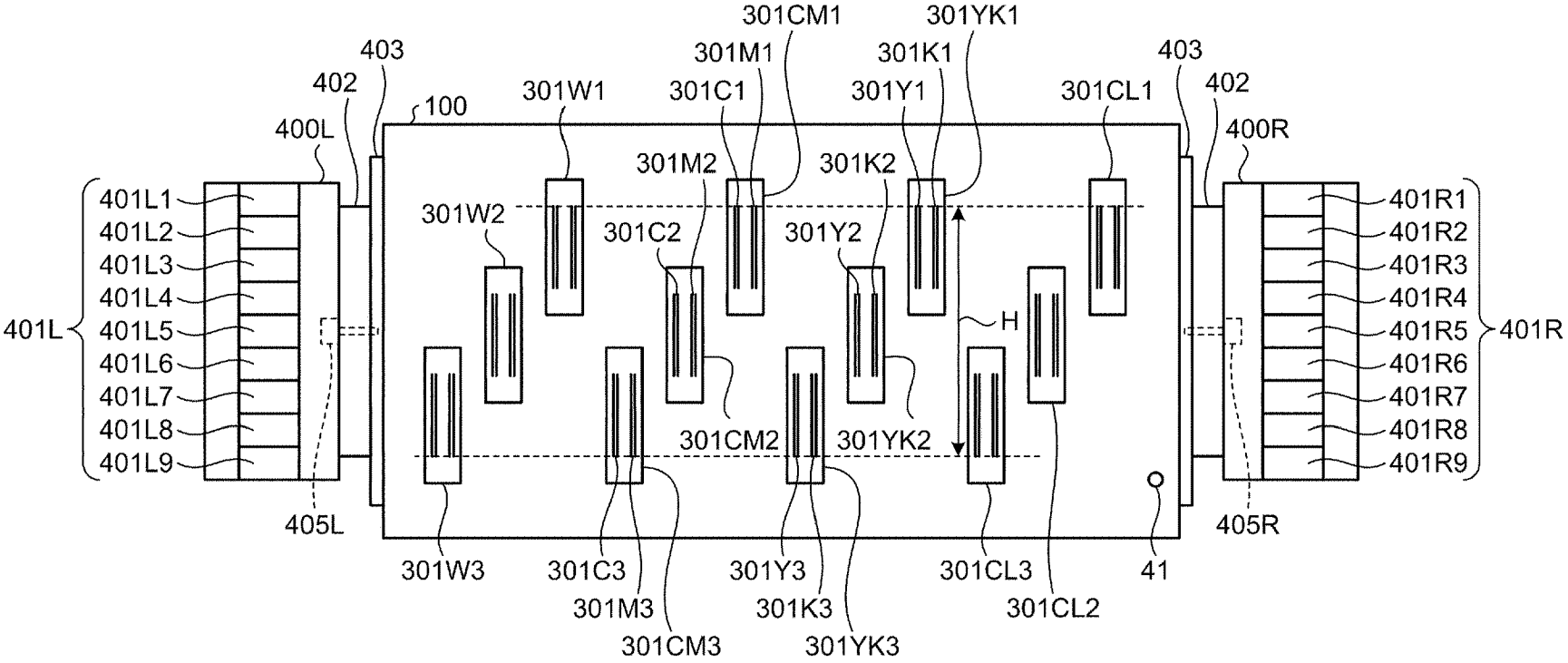

[Fig. 5]
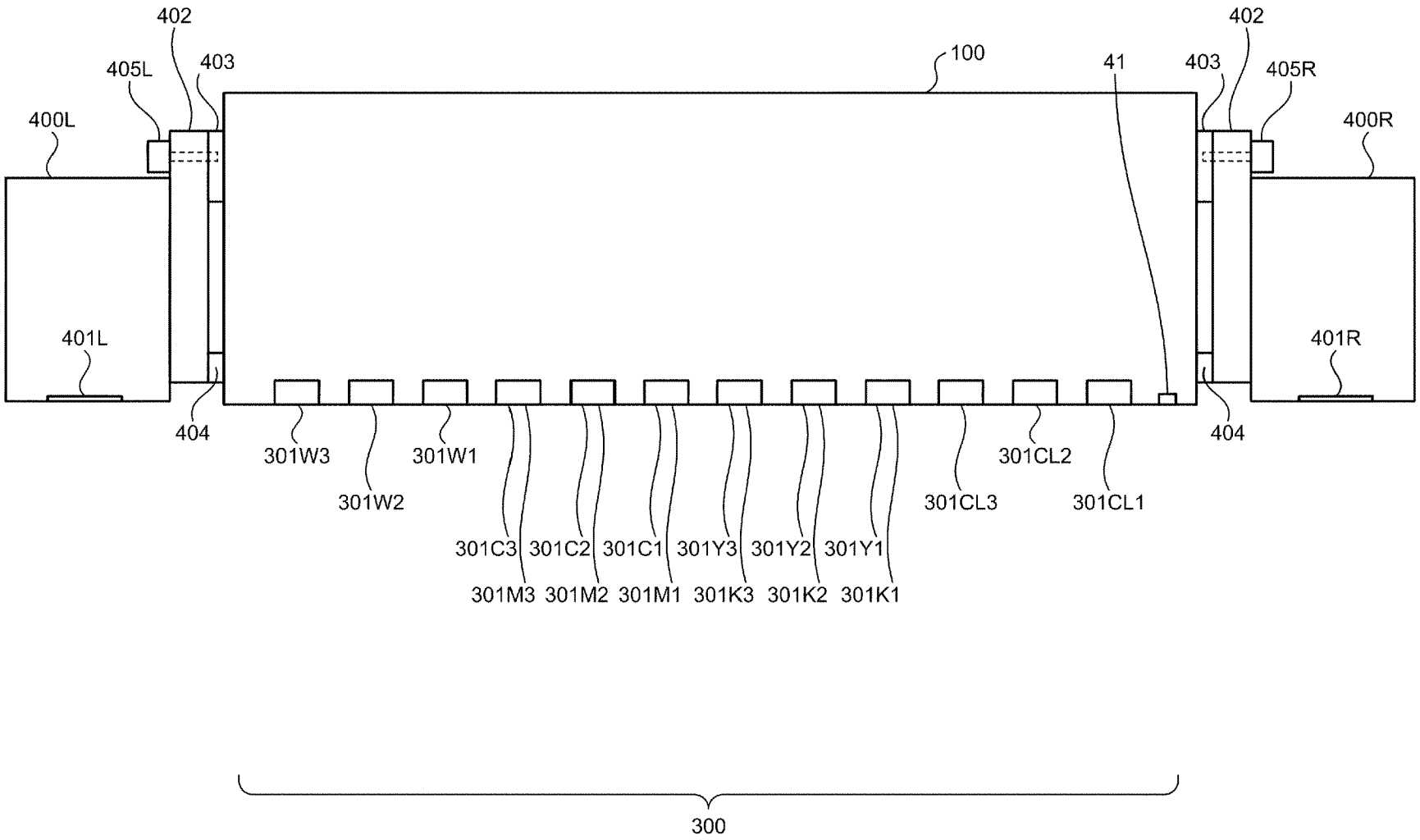

[Fig. 6]
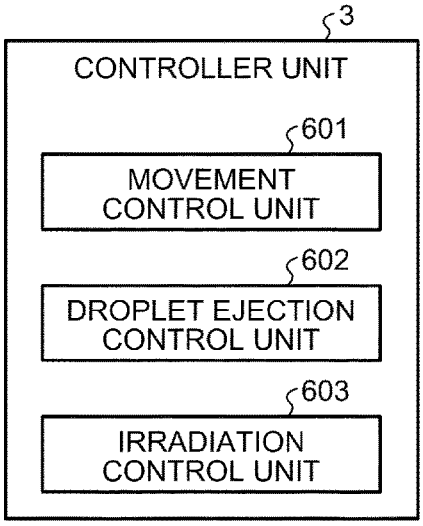
[Fig. 7]
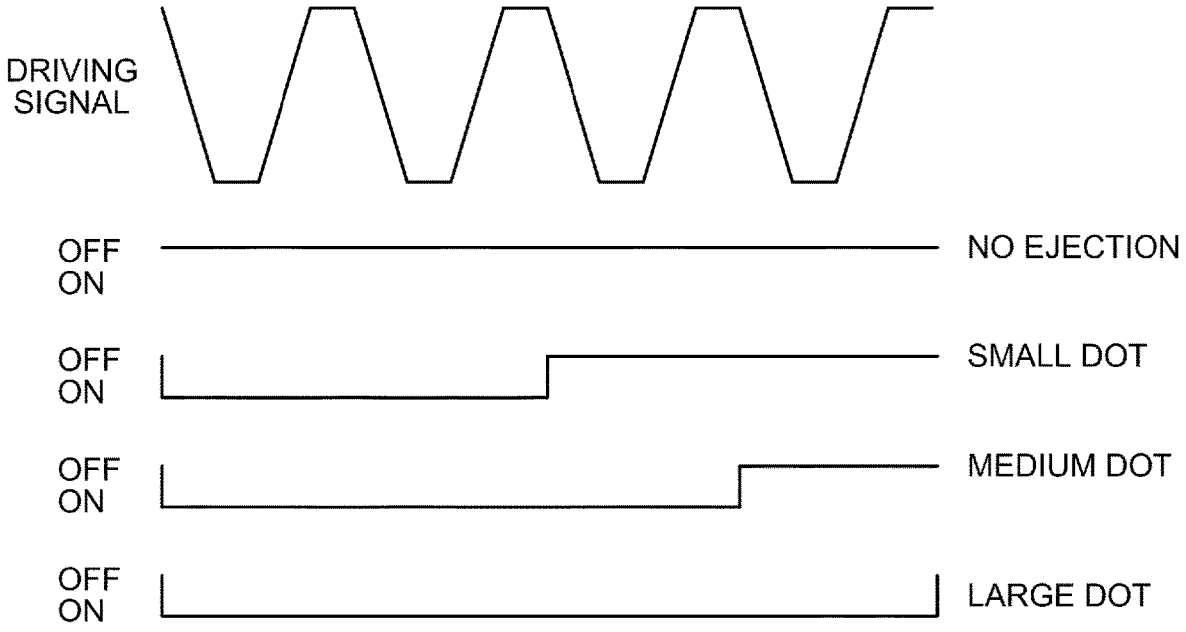

[Fig. 8]
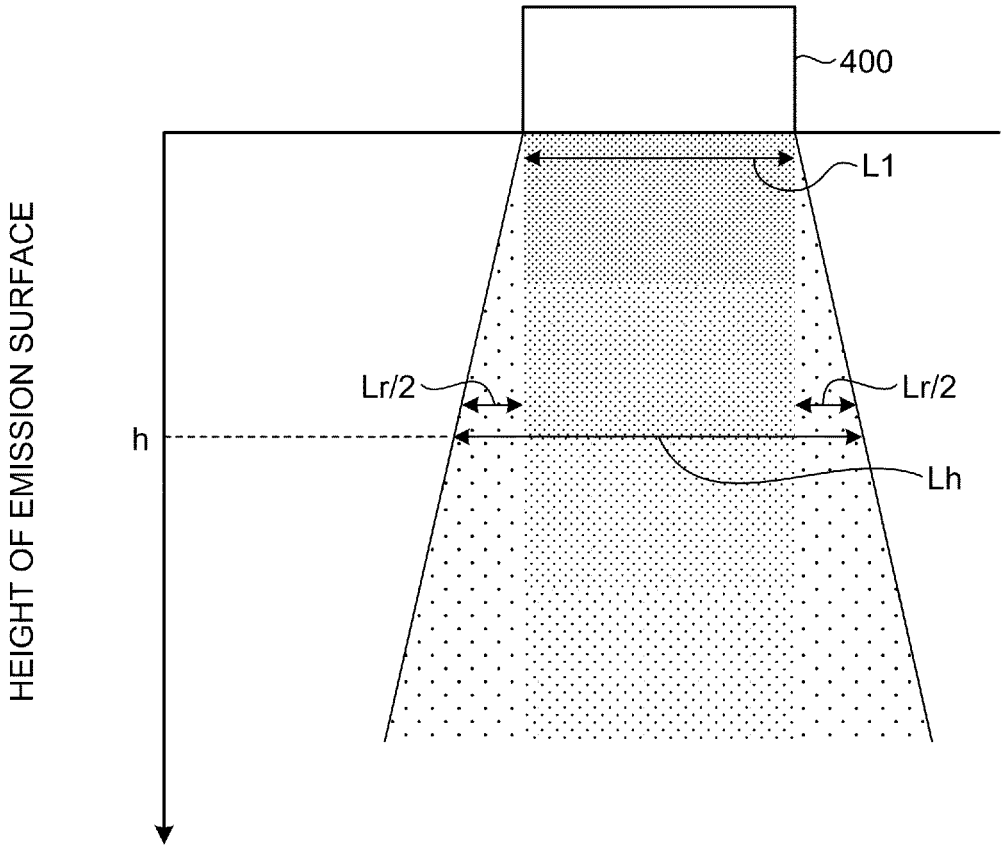

[Fig. 9]
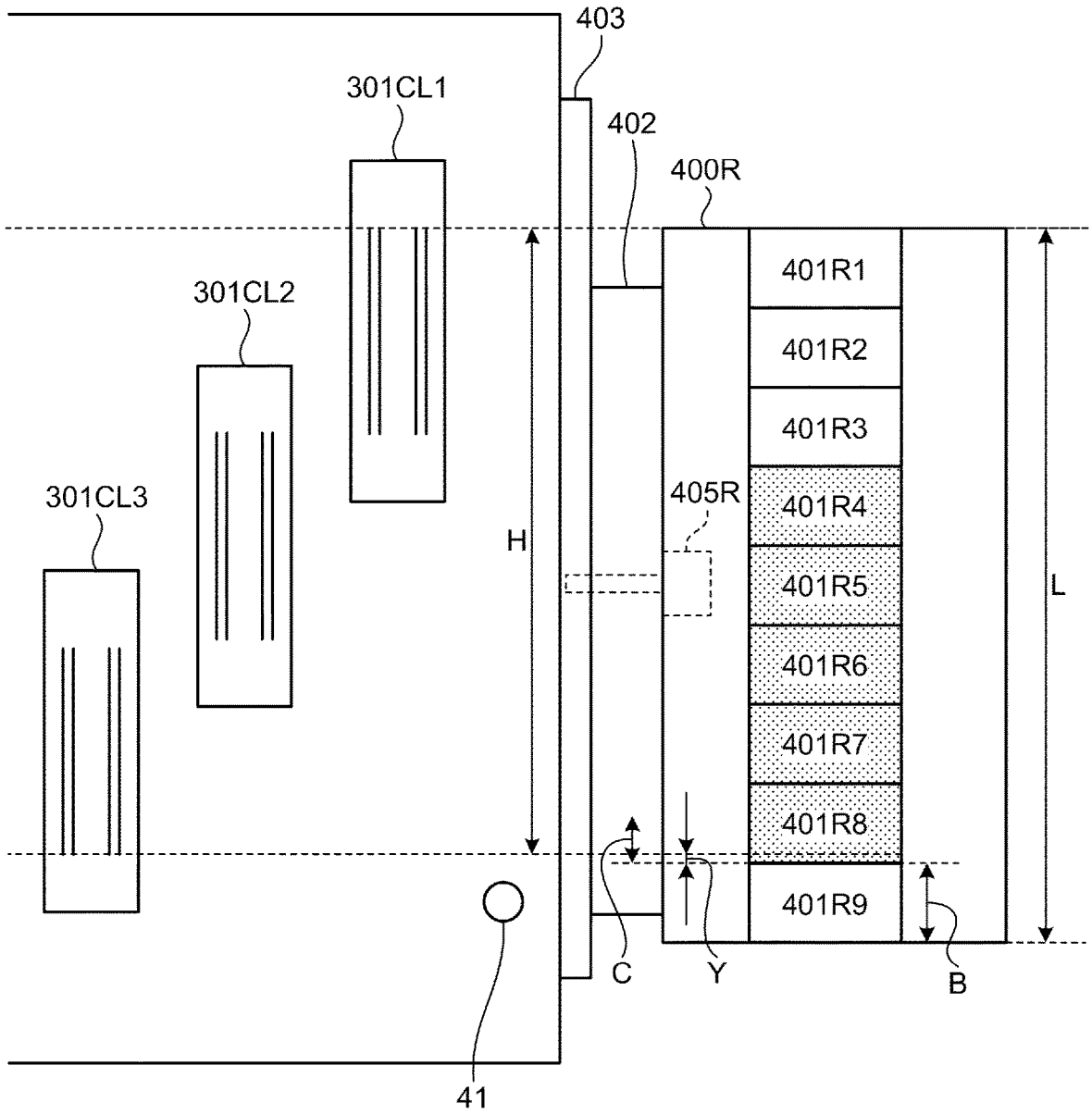

[Fig. 10]
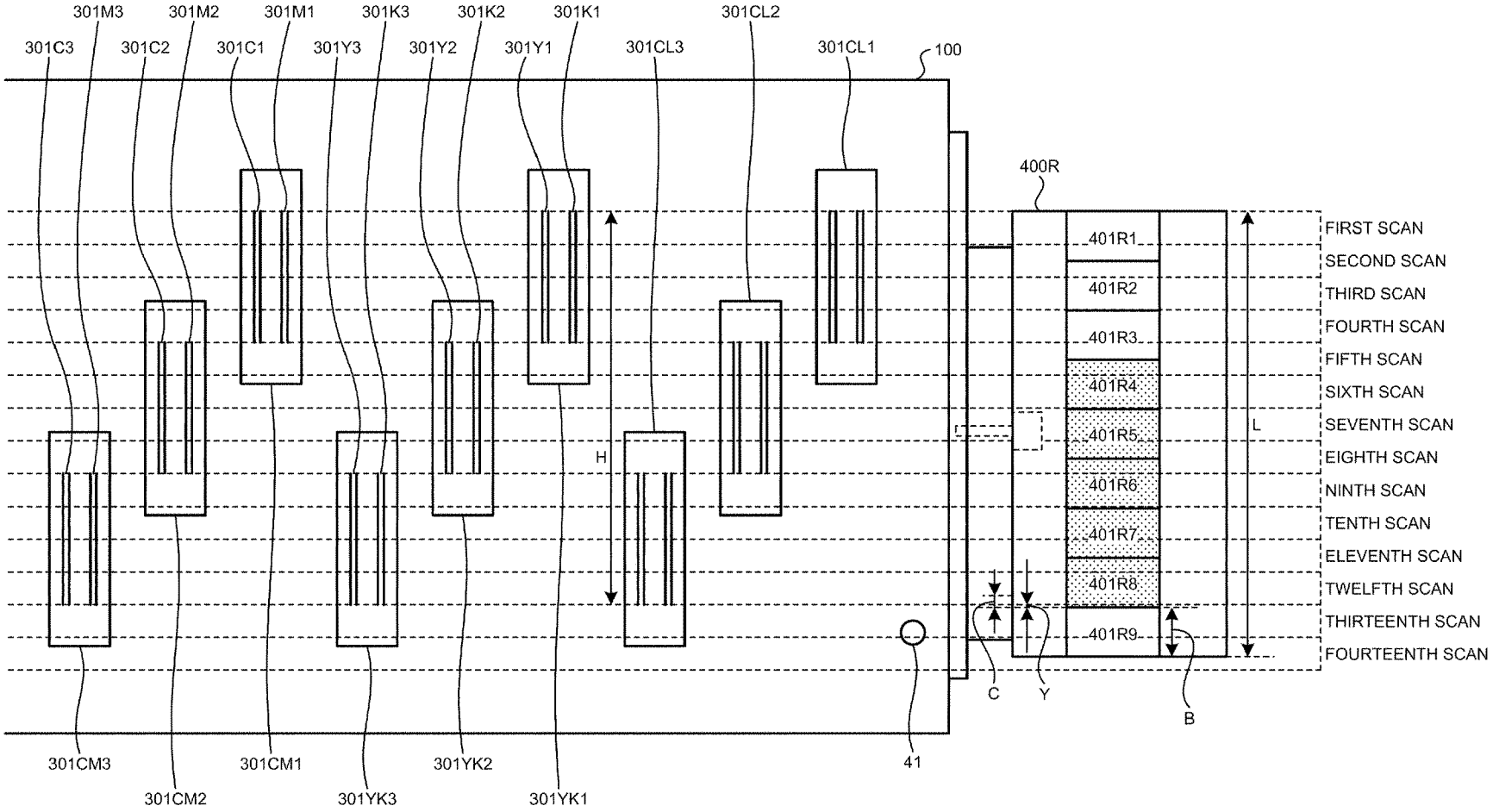

[Fig. 11]
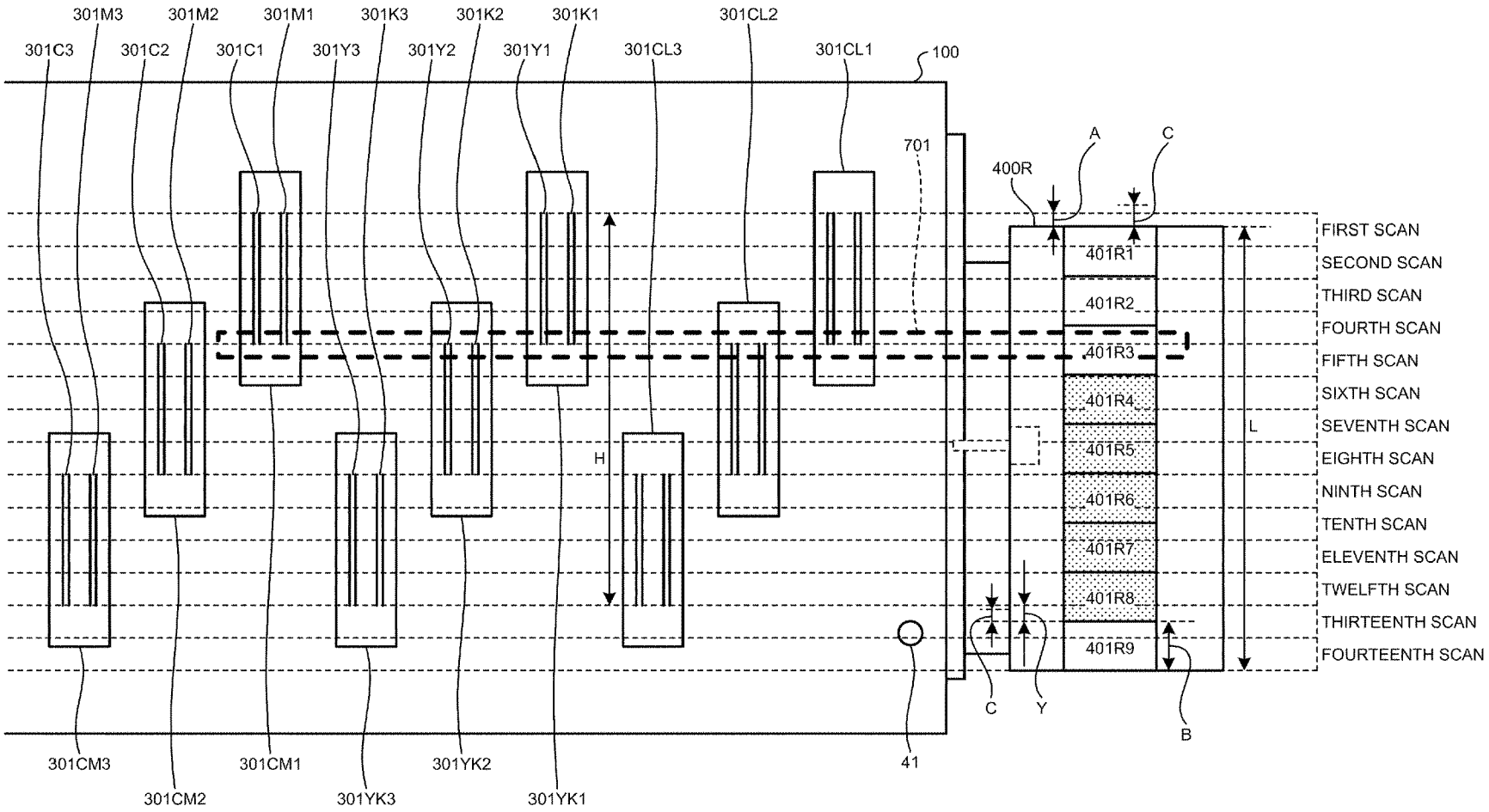

[Fig. 12]
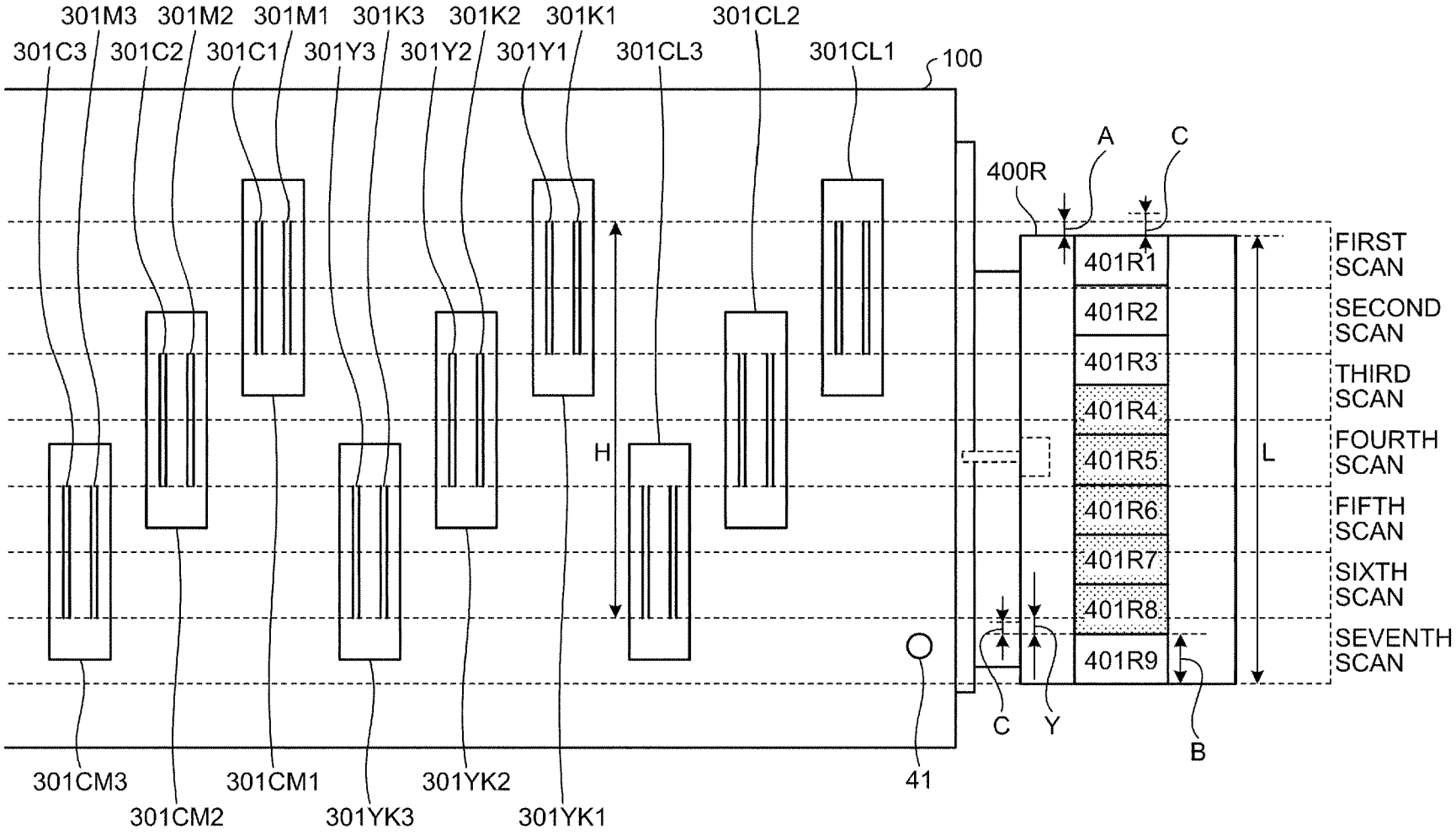

[Fig. 13]
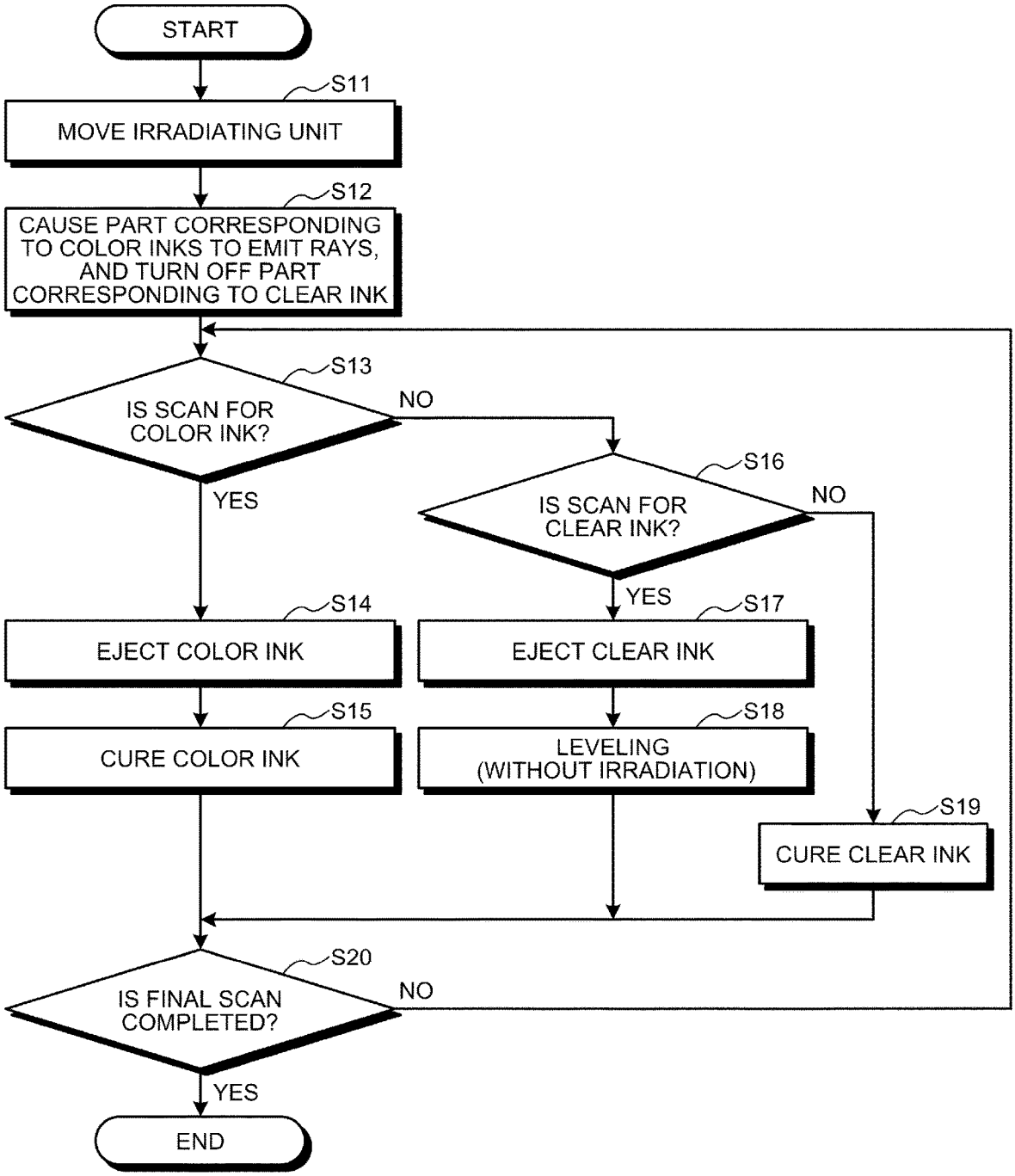

[Fig. 14]
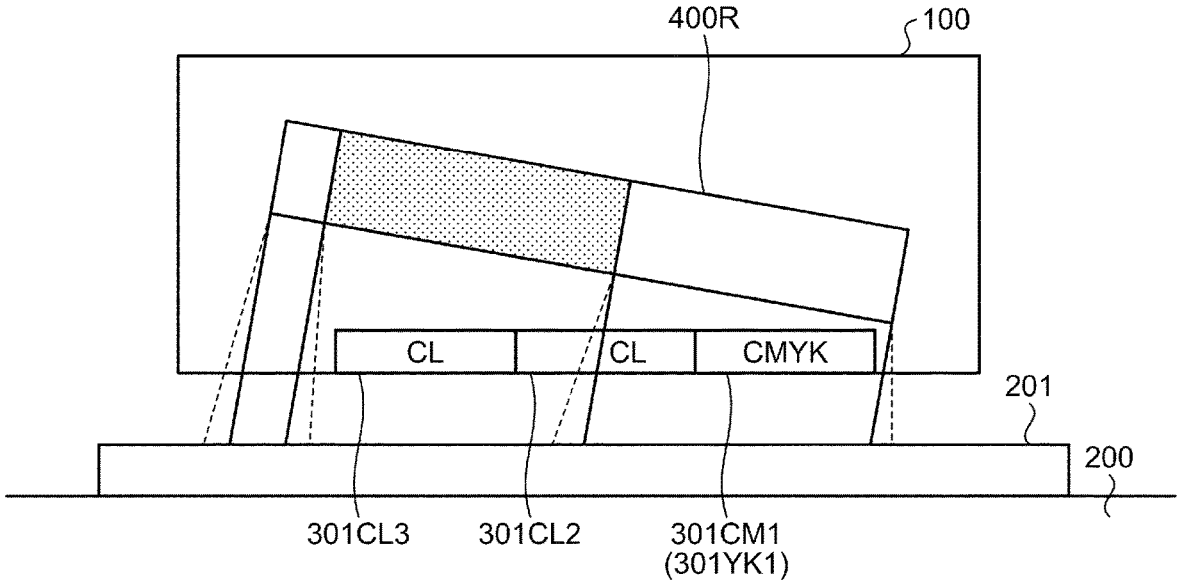

EJECTING APPARATUS, IMAGE FORMING APPARATUS, CURING METHOD UTILIZING IRRADEATING BLOCKS AND COMPUTER-READABLE MEDIUM

TECHNICAL FIELD

The present invention relates to an ejecting apparatus, an image forming apparatus, a curing method, and a computer-readable medium.

BACKGROUND ART

An inkjet apparatus that forms an image with an activation energy ray curable liquid, such as an ultra-violet (UV) curable ink, has conventionally been known. Use of a technology for performing gloss coating with a clear ink, in order to achieve glossiness on a printout, in the UV-curable inkjet apparatus has also been known.

Normally, during color printing performed by the UV-curable inkjet apparatus, the ink is cured immediately after the ink is ejected, by irradiating the ink with UV rays. By contrast, when performing the gloss coating, the clear ink is irradiated with UV rays after the ink has become levelled (smoothed), instead of irradiating the ink immediately after the clear ink is ejected. At this time, if the clear ink has the same composition as the color ink, the color coating becomes dissolved with the clear ink, while the clear ink is being ejected and levelled, unless the clear ink is cured immediately after the clear ink is levelled. Therefore, in order to prevent such dissolution, the clear ink needs to be ejected and irradiated with UV rays as a continuous process. To perform gloss coating as a continuous processes, it is possible to use a configuration provided with two irradiators, one being a color-printing UV irradiator that irradiates the color ink with UV rays immediately after the color ink is ejected, and the other being a clear-coating UV irradiator that irradiates the clear ink with UV rays after the clear ink has become levelled. It is also possible to use a configuration including one irradiator that achieves the same effect as that achieved by two irradiators, by partly turning off the irradiator.

For example, in the configuration in which one irradiator is partly turned off to achieve the same effect as that achieved by two irradiators, it is preferable for the irradiator to have one part that emits rays (turned on) and the other part that is turned off, depending on the configuration of heads and the number of scans. As an example of such a technology of implementing an irradiator having one part emitting rays (turned on) and the other part that is turned off, there has been a disclosure of a technology in which, when the number of passes is n, the rays are emitted immediately after the ink is ejected up to the $n-m^{th}$ pass, the clear ink is allowed to level in the $m^{th}$ pass, and the levelled clear ink is irradiated with rays in the remaining passes to achieve a gloss finish (see Patent Literature 1).

SUMMARY OF INVENTION

Technical Problem

However, the technology disclosed in Patent Literature 1 controls to cause a part having the same width as the scan width to be turned on, and the irradiator is caused to emit rays and turned off exactly in units of one scan. Therefore, some efforts have been required to newly develop an irradiator supporting such turning-on control based on the number of scans, and the cost will be increased, compared with use of a general-purpose irradiator.

The present invention is made in consideration of the above, and has an object to accurately perform gloss coating at a lower cost.

Solution to Problem

In order to solve the above problem and achieve the object, according to one aspect of the present invention, an ejecting apparatus includes an ejection control unit, an irradiating unit, an irradiation control unit. The ejection control unit is configured to cause a first ejecting unit among ejecting units configured to move in a main-scanning direction, to eject a liquid that is activation energy ray curable, to a recording medium. The irradiating unit is configured to emit an activation energy ray and divided into a plurality of irradiating blocks in a sub-scanning direction perpendicular to the main-scanning direction. The irradiation control unit is configured to turn off an irradiating block corresponding to the first ejecting unit moving in the main-scanning direction, among the plurality of irradiating blocks. The irradiating unit is positioned in such a manner that a first distance is larger than a second distance. The first distance is a distance between a downstream end of the first ejecting unit in the sub-scanning direction and an upstream end of an irradiating block that is positioned downstream among the plurality of irradiating blocks. The second distance is a distance by which the irradiating block irradiates the recording medium outside from an end of an emission surface of the irradiator block in the sub-scanning direction. The irradiation control unit is configured to cure the liquid by causing the irradiating block positioned downstream of the turned-off irradiating block corresponding to the first ejecting unit in the sub-scanning direction, to emit the activation energy ray.

Advantageous Effects of Invention

According to the present invention, gloss coating can be performed accurately at a lower cost.

BRIEF DESCRIPTION OF DRAWINGS

FIG. 1 is a schematic illustrating one example of a hardware configuration of an image forming apparatus according to an embodiment.

FIG. 2 is a side view of the image forming apparatus according to the embodiment.

FIG. 3 is a top view of the image forming apparatus according to the embodiment.

FIG. 4 is a bottom view of relevant parts (a main scanning unit and an irradiating unit) of the image forming apparatus according to the embodiment.

FIG. 5 is a sectional side view of the relevant parts (the main scanning unit and the irradiating unit) of the image forming apparatus according to the embodiment.

FIG. 6 is a schematic illustrating one example of a functional block configuration of the image forming apparatus (controller unit) according to the embodiment.

FIG. 7 is a schematic illustrating one example of a driving signal and an amount of ink ejected, in the image forming apparatus according to the embodiment.

FIG. 8 is a schematic for explaining one example of a relation between a travelling distance of and a width irradiated with the UV rays that are emitted from the irradiating unit in the image forming apparatus according to the embodiment.

FIG. 9 is an enlarged bottom view of the main scanning unit and the irradiating unit in the image forming apparatus according to the embodiment.

FIG. 10 is a schematic illustrating one example of a positional relation between a head unit and the irradiating unit when Y<C, with an image forming process performed in a gloss-coating mode, by the image forming apparatus according to the embodiment.

FIG. 11 is a schematic illustrating one example of a positional relation of the irradiating unit having moved with respect to the head unit as the image forming apparatus according to the embodiment operates in the gloss-coating mode.

FIG. 12 is a schematic for explaining an example in which the scan width that is larger than the irradiating block width is used.

FIG. 13 is a flowchart illustrating one example of the sequence of an image forming process (including a curing process) performed by the image forming apparatus according to the embodiment.

FIG. 14 is a schematic illustrating one example of positioning of an irradiating unit in an image forming apparatus according to a modification.

DESCRIPTION OF EMBODIMENTS

An embodiment of an ejecting apparatus, an image forming apparatus, a curing method, and a computer-readable medium according to the present invention will now be explained in detail with reference to FIGS. 1 to 14. The embodiment described below is, however, not intended to limit the scope of the present invention in any way. The elements described in the embodiment include those can be easily thought of by those skilled in the art, those that are substantially the same, and those that fall within what is called the scope of equivalency. Furthermore, various omissions, replacements, modifications, and combinations of such elements are possible within the scope not deviating from the essence of the embodiment described below.

(Overall Configuration of Image Forming Apparatus)

FIG. 1 is a schematic illustrating one example of a hardware configuration of an image forming apparatus according to the embodiment. FIG. 2 is a side view of the image forming apparatus according to the embodiment. FIG. 3 is a top view of the image forming apparatus according to the embodiment. An overall configuration (hardware configuration) of the image forming apparatus according to the embodiment will now be explained with reference to FIGS. 1 to 3.

As illustrated in FIG. 1, this image forming apparatus 1 according to the embodiment includes a controller unit 3, a detector group 4, a main scanning unit 100, a sub-scanning unit 200, a head unit 300 (ejecting unit), an irradiating unit 400 (irradiating unit), and a maintenance unit 500.

The controller unit 3 is a device that controls the operations of the units included in the image forming apparatus 1. The controller unit 3 includes, as illustrated in FIG. 1, a unit control circuit 31, a read-only memory (ROM) 32, a memory 33, a central processing unit (CPU) 34, and an interface (I/F) 35. The "ejecting apparatus" according to the present invention may be any apparatus at least including the controller unit 3 and the irradiating unit 400, for example.

The unit control circuit 31 is a circuit that controls the operations of the main scanning unit 100, the sub-scanning unit 200, the head unit 300, the irradiating unit 400, and the maintenance unit 500, in response to a command received from the CPU 34.

The CPU 34 controls the operation of the entire image forming apparatus 1 by executing a computer program stored in the ROM 32, using the memory 33 as a working area. Specifically, the CPU 34 controls the operations of the main scanning unit 100, the sub-scanning unit 200, the head unit 300, the irradiating unit 400, and the maintenance unit 500, via the unit control circuit 31. The CPU 34 also controls these units based on record data received from a personal computer (PC) 2 illustrated in FIG. 1, and detection data detected by the detector group 4, and forms an image on a base material.

The I/F 35 is an interface for establishing a connection for enabling the image forming apparatus 1 to perform data communication with the external PC 2. In FIG. 1, the I/F 35 in the image forming apparatus 1 is directly connected to the PC 2, but the embodiment is not limited thereto, and the I/F 35 may connect to the PC 2 over a network, or perform data communication with the PC 2 over wireless communication, for example.

A printer driver is installed on the PC 2, and the PC 2 generates record data to be transmitted to the image forming apparatus 1, from image data, using the printer driver. The record data contains command data for causing the units such as the sub-scanning unit 200 in the image forming apparatus 1 to operate, and pixel data that is related to an image. The pixel data has, for example, two-bit data in each pixel, and is expressed in four gradients.

The detector group 4 includes various types of sensors required for the image forming apparatus 1 to operate. For example, the detector group 4 includes sensors such as a height sensor 41 illustrated in FIGS. 4 and 5, which will be described later.

The main scanning unit 100 is a unit that moves in a Z axis direction (height direction) illustrated in FIG. 2 and in an X axis direction (main-scanning direction) illustrated in FIGS. 2 and 3, in response to a driving signal received from the unit control circuit 31. To move in the main-scanning direction, the main scanning unit 100 is moved in the main-scanning direction by a timing belt 101 (see FIGS. 2 and 3) stretched across a pulley, not illustrated, that extends in the main-scanning direction.

The sub-scanning unit 200 is a unit that moves a base material 201 (one example of a recording medium) that is placed on the sub-scanning unit 200 illustrated in FIGS. 2 and 3 in a Y axis direction illustrated in FIG. 3 (sub-scanning direction), in response to a driving signal received from the unit control circuit 31. The sub-scanning unit 200 is also provided with an attracting mechanism, and fixes the base material 201 placed by a user by attracting the base material 201 with the attracting mechanism.

The head unit 300 is a unit including heads for ejecting yellow (Y), magenta (M), cyan (C), black (K), clear (CL), and white (W) UV-curable inks (examples of an ink that is activation energy ray curable), respectively. The head unit 300 is provided to the bottom surface of the main scanning unit 100. An arrangement and a configuration of the heads in the head unit 300 will be explained later with reference to FIGS. 4 and 5.

Each head in the head unit 300 has a piezoelectric element, and, when the piezoelectric element receives an application of a driving signal from the unit control circuit 31, a contracting motion takes place in the head unit 300, and a pressure change resulting from the contracting motion causes a UV-curable ink to be ejected to the base material.

As a result, a surface applied with the ink is formed on the base material. Examples of the UV-curable ink according to the embodiment includes an ink including acrylate-based monomer or methacrylate-based monomer, for example. A methacrylate-based monomer is relatively less skin sensitizing, advantageously, but exhibits greater cure shrinkage than a general ink does.

The irradiating unit 400 is provided to two perpendicular side surfaces of the main scanning unit 100, being perpendicular to the X axis direction (main-scanning direction). The irradiating unit 400 is a unit for emitting UV rays (one example of an activation energy ray), in response to a driving signal received from the unit control circuit 31. The irradiating unit 400 includes a UV irradiation lamp that mainly emits UV rays. This UV irradiation lamp is implemented by a light emitting diode (LED), for example. The irradiating unit 400 includes an irradiating unit 400L that is provided to one of the perpendicular side surfaces of the main scanning unit 100, being perpendicular to the X axis direction (main-scanning direction), and an irradiating unit 400R that is provided to the other surface, as illustrated in FIGS. 2 and 3.

The maintenance unit 500 is a unit that cleans (performs a maintenance of) the heads of the head unit 300, in order to maintain and to recover the performance of the heads of the head unit 300, in the main scanning unit 100 having moved above the maintenance unit 500. Specifically, the maintenance unit 500 includes a wiper unit 501, as illustrated in FIGS. 2 and 3. A pressurizing mechanism provided to the main scanning unit 100 causes a certain amount of ink to be ejected from each head, and the wiper unit 501 wipes the ink having attached to the surface of each head, as the ink is ejected, by being elevated and moved in the sub-scanning direction.

The hardware configuration of the image forming apparatus 1 illustrated in FIG. 1 is merely one example, and it is not necessary for every element illustrated in FIG. 1 to be included, and any other additional elements may be included.

(Details of Configurations of Head Unit and Irradiating Unit)

FIG. 4 is a bottom view of relevant parts (the main scanning unit and the irradiating unit) of the image forming apparatus according to the embodiment. FIG. 5 is a sectional side view of the relevant parts (the main scanning unit and the irradiating unit) of the image forming apparatus according to the embodiment. Configurations of the head unit 300 and the irradiating unit 400 included in the image forming apparatus 1 according to the embodiment will now be explained in detail with reference to FIGS. 4 and 5.

As illustrated in FIGS. 4 and 5, the head unit 300 for ejecting a UV-curable ink (hereinafter, sometimes simply referred to as an "ink") is provided to the bottom surface of the main scanning unit 100. The head unit 300 includes heads 301CM1 to 301CM3 for ejecting cyan (C) and magenta (M) color inks, heads 301YK1 to 301YK3 for ejecting yellow (Y) and black (K) color inks, heads 301W1 to 301W3 for ejecting a white (W) color ink, and heads 301CL1 to 301CL3 for ejecting a clear ink with which gloss coating is performed. Any one or all of these heads included in the head unit 300 is/are sometimes, representatively or collectively, simply referred to as "a head(s) 301".

As illustrated in FIG. 4, each of the heads 301 is provided with four nozzle rows each of which has a plurality of nozzle holes, from which ink is ejected, arranged in the sub-scanning direction. Among these heads, the head 301CM1 includes an ejecting unit 301C1 including two nozzle rows for ejecting the cyan (C) color ink, and an ejecting unit 301M1 including two nozzle rows for ejecting the magenta (M) color ink. In the same manner, the head 301CM2 includes an ejecting unit 301C2 and an ejecting unit 301M2, and the head 301CM3 includes an ejecting unit 301C3 and an ejecting unit 301M3. The head 301YK1 includes an ejecting unit 301Y1 with two rows of nozzles for ejecting the yellow (Y) color ink, and an ejecting unit 301K1 with two rows of nozzles for ejecting the black (K) color ink. In the same manner, the head 301YK2 includes an ejecting unit 301Y2 and an ejecting unit 301K2, and the head 301YK3 includes an ejecting unit 301Y3 and an ejecting unit 301K3.

The white (W) color ink ejected from the heads 301W1 to 301W3 is used to as a white ink for the base material 201 having a base color other than white. The clear ink ejected from the heads 301CL1 to 301CL3 is used to form a gloss-coating layer on the base material 201, or over the color inks applied on the base material 201. The ink that is ejected from the heads 301CL1 to 301CL3 and with which the gloss-coating layer is formed is not limited to a clear ink with no color, and may be an opaque ink, or an ink with some color added, for example.

As illustrated in FIG. 4, the three heads 301 corresponding to each color are arranged in the sub-scanning direction, in a manner offset from one another in the main-scanning direction. For example, the heads 301W1 to 301W3 for ejecting the white (W) color ink are arranged in the sub-scanning direction in a manner offset from one another in the main-scanning direction. This arrangement of the heads 301 corresponding to each color determines a length H by which the ink of this color is ejected, in the sub-scanning direction, as illustrated in FIG. 4.

Furthermore, as illustrated in FIGS. 4 and 5, the height sensor 41 is provided to the bottom surface of the main scanning unit 100. The height sensor 41 measures the distance (gap) to the base material 201, that is, the height of the bottom surface of the main scanning unit 100 with respect to the base material 201. Based on the gap measured by the height sensor 41, the main scanning unit 100 is moved in the Z axis direction until the gap between the main scanning unit 100 (the head unit 300) and the base material 201 is matched with a target setting (for example, 1 millimeter).

As mentioned earlier, the irradiating unit 400 includes the irradiating unit 400L and the irradiating unit 400R that are provided to the perpendicular side surfaces of the main scanning unit 100, being perpendicular to the X axis direction. Each of the irradiating unit 400L and the irradiating unit 400R is divided into a plurality of irradiating blocks, and each of the irradiating blocks is configured in such a manner that the LED output thereof is independently controllable. In the example illustrated in FIG. 4, an irradiating block 401L is divided into nine irradiating blocks (irradiating blocks 401L1 to 401L9). The irradiating blocks 401L1 to 401L9 are simply referred to as "an irradiating block(s) 401L" when referring to any one of the irradiating blocks or when collectively referring to the irradiating blocks. An irradiating block 401R is divided into nine irradiating blocks (irradiating blocks 401R1 to 401R9). The irradiating blocks 401R1 to 401R9 are simply referred to as an "irradiating block(s) 401R" when referring to any one of the irradiating blocks or when collectively referring to the irradiating blocks. The range of each irradiating block covers a range from the most upstream to the most downstream in the sub-scanning direction, for example.

As illustrated in FIGS. 4 and 5, each of the irradiating unit 400L and the irradiating unit 400R is connected to a lamp moving mechanism 402 (one example of an irradiation moving unit). The lamp moving mechanism 402 is connected to a lamp fixing mechanism 403 and a guide rail 404 that are fixed to the main scanning unit 100. The irradiating unit 400L and the irradiating unit 400R are fixed to the lamp fixing mechanisms 403 by inserting lamp fixing pins 405L and 405R into holes provided to the lamp moving mechanisms 402 and the lamp fixing mechanisms 403. The irradiating unit 400L (400R) is unfixed from the lamp fixing mechanism 403 by removing the lamp fixing pin 405L (405R) from the lamp moving mechanism 402. Once the irradiating unit 400L (400R) is unfixed from the lamp fixing mechanism 403, the irradiating unit 400L (400R) can be moved manually along the guide rail 404, that is, in the sub-scanning direction. Once the irradiating unit 400L (400R) is moved to a specific position in the sub-scanning direction, the irradiating unit 400L (400R) can be fixed to the lamp fixing mechanism 403 with the lamp fixing pin 405L (405R). In this manner, the irradiating unit 400L (400R) can irradiate the ink applied to the base material 201 with UV rays at the specific fixed position in the sub-scanning direction.

In the example described above, the irradiating unit 400L (400R) is moved manually in the sub-scanning direction with respect to the main scanning unit 100 (the lamp fixing mechanism 403), but the present invention is not limited thereto. In other words, the lamp moving mechanism 402 may be provided with an actuator (one example of an irradiation moving unit) for moving the irradiating unit 400L (400R) in the sub-scanning direction, so that the irradiating unit 400L (400R) can be moved automatically to a specific position in the sub-scanning direction.

An image forming process (including a curing process) performed by the image forming apparatus 1 according to the embodiment will now be explained briefly.

To begin with, the sub-scanning unit 200 moves in the sub-scanning direction (Y axis direction) in response to a driving signal received from the CPU 34 (the unit control circuit 31), to move the base material 201 to an initial value for forming the image.

The main scanning unit 100 then moves to a height suitable for allowing the head unit 300 to eject the UV-curable ink (e.g., a height at which the head unit 300 and the base material 201 forms a gap of 1 millimeter), in response to a driving signal received from the CPU 34 (the unit control circuit 31). At this time, the CPU 34 recognizes the height of the head unit 300 with respect to the base material 201 based on detection data related to the height detected by the height sensor 41.

The main scanning unit 100 then moves reciprocally (scans) in the main-scanning direction (X axis direction), in response to a driving signal received from the CPU 34 (the unit control circuit 31). As the main scanning unit 100 moves reciprocally, the head unit 300 ejects color inks (energy-curable colored liquids), in response to a driving signal received from the CPU 34 (the unit control circuit 31). As a result, an image corresponding to one scan is formed on the base material 201. As the main scanning unit 100 moves reciprocally, the color ink ejected on the base material 201 is cured by the irradiation with the UV rays emitted from the irradiating unit 400. The sub-scanning unit 200 then moves by a width corresponding to one scan (hereinafter, sometimes referred to as a "scan width") in the sub-scanning direction (Y axis direction), in response to a driving signal received from the CPU 34 (the unit control circuit 31). In the process thereafter, the operation of forming an image corresponding to one scan and the operation of moving the sub-scanning unit 200 by the scan width in the sub-scanning direction are repeated until the image formation is completed.

When gloss coating with a clear ink is to be performed, the operation of the irradiating unit 400 is withheld for a time period allowing the clear ink to smooth out (to level) (hereinafter, sometimes referred to as "levelling time"), instead of curing the clear ink by irradiating the clear ink with UV rays immediately after the clear ink is ejected, and then the clear ink having levelled is cured by the irradiation with the UV rays emitted from the irradiating unit 400, and the gloss coating layer is formed thereby.

(Functional Configuration of Controller Unit)

FIG. 6 is a schematic illustrating one example of a functional block configuration of the image forming apparatus (controller unit) according to the embodiment. FIG. 7 is a schematic illustrating one example of a driving signal and an amount of ink ejected, in the image forming apparatus according to the embodiment. FIG. 8 is a schematic for explaining one example of a relation between a travelling distance of and a width irradiated with the UV rays that are emitted from the irradiating unit in the image forming apparatus according to the embodiment. A functional block configuration of the controller unit 3 included in the image forming apparatus 1 according to the embodiment will now be explained with reference to FIGS. 6 to 8.

As illustrated in FIG. 6, the controller unit 3 according to the embodiment includes a movement control unit 601, a droplet ejection control unit 602 (ejection control unit), and an irradiation control unit 603.

The movement control unit 601 is a functional unit that causes the unit control circuit 31 to apply driving signals to the main scanning unit 100 and the sub-scanning unit 200, to move the main scanning unit 100 in the Z axis direction (height direction) and the X axis direction (main-scanning direction), and to move the sub-scanning unit 200 in the Y axis direction (sub-scanning direction). The movement control unit 601 is implemented by a computer program executed by the CPU 34 illustrated in FIG. 1, for example.

The droplet ejection control unit 602 is a functional unit that controls an ink ejecting operation of the head unit 300. The droplet ejection control unit 602 causes the unit control circuit 31 to apply a driving signal such as that illustrated in FIG. 7 to the head unit 300, and controls the amount of ink ejected (e.g., "no ejection", "small dot", "medium dot", and "large dot" illustrated in FIG. 7) using an on/off mask signal. The droplet ejection control unit 602 determines the amount to be ejected by selecting a mask signal based on the gradation of a pixel. The droplet ejection control unit 602 is implemented by a computer program executed by the CPU 34 illustrated in FIG. 1, for example.

The irradiation control unit 603 is a functional unit that causes the unit control circuit 31 to apply a driving signal to the irradiating unit 400, and controls the operation of UV ray emissions, in units of an irradiating block 401L and an irradiating block 401R of the irradiating unit 400.

FIG. 8 illustrates how the UV rays from a specific irradiating block 401L (401R) of the irradiating unit 400 are emitted. The UV rays emitted from the irradiating block 401L (401R) spread radially, as illustrated in FIG. 8. FIG. 8 depicts how the UV rays emitted from the irradiating block 401L (401R) spread in the sub-scanning direction. When an irradiation width L1 is the width of UV rays in the sub-scanning direction immediately after the rays are emitted from the emission surface of the irradiating block 401L (401R), it can be seen that the irradiation width (irradiated range) of the UV rays in the sub-scanning direction broadens, as the travelling distance of the UV rays becomes extended, as illustrated in FIG. 8. In this case, the UV rays exhibit a property that, as the travelling distance of the UV rays becomes extended, the rays become more dispersed and the luminance drops by a larger degree.

When h denotes the height of the emission surface of the irradiating block 401L (401R) with respect to the base material 201 (hereinafter, sometimes simply referred to as an "emission surface height"), an irradiation width Lh irradiated with the UV rays at this height h is broader than the irradiation width L1, in the sub-scanning direction. In other words, the irradiation width Lh has a protruding part Lr/2 (Lr=Lh−L1) protruding from the irradiation width L1, and therefore, it is necessary to consider the effect given to how the ink is cured, by the UV rays corresponding to the protruding part Lr/2. This point will be described later in detail with reference to FIGS. 10 to 12.

(Positional Adjustment of Irradiating Unit in Operation in Gloss-Coating Mode)

FIG. 9 is an enlarged bottom view of the main scanning unit and the irradiating unit in the image forming apparatus according to the embodiment. FIG. 10 is a schematic illustrating one example of a positional relation between the head unit and the irradiating unit when Y<C, with the image forming process performed in the gloss-coating mode, by the image forming apparatus according to the embodiment. FIG. 11 is a schematic illustrating one example of a positional relation of the irradiating unit having moved with respect to the head unit, as the image forming apparatus according to the embodiment operates in the gloss-coating mode. Positional adjustment of the irradiating unit 400 for the operation of the image forming apparatus 1 in a gloss-coating mode according to the embodiment will now be explained with reference to FIGS. 9 to 11. The gloss-coating mode herein means an operation mode in which a glossy image is formed by forming an image with color inks first, and then a gloss-coating layer is formed by ejecting a clear ink onto the color ink. FIGS. 9 to 11 will be explained below focusing on the irradiating unit 400R, which is one of the irradiating units 400L, 400R provided to the irradiating unit 400.

As illustrated in the enlarged view in FIG. 9, in addition to denoting the length by which a color ink is ejected from the corresponding head 301 in the sub-scanning direction by H, denoting the length of the irradiating unit 400 (400R) in the sub-scanning direction by L, denoting the length of one irradiating block 401R in the sub-scanning direction by B, and denoting the distance between the most downstream end of the head 301 in the sub-scanning direction (where the downstream side being the lower side in the view facing the paper surface in FIG. 9; that is, the side on which the head unit 300 (and the irradiating unit 400) scans last within a specific area of the base material 201) and the upstream end of a downstream irradiating block that is turned on (the irradiating block 401R9 in the example illustrated in FIG. 9), among those included in the irradiating unit 400R, by Y (first distance), L=H+Y+B is established.

In the example illustrated in FIG. 9, the irradiating blocks 401R1 to 401R3, 401R9 are caused to emit rays, and the irradiating blocks 401R4 to 401R8 are turned off, among the irradiating blocks 401R included in the irradiating unit 400R. In such a case, the UV rays emitted from the irradiating block 401R9, which is responsible for curing the clear ink, as will be described later, has a protruding part based on the travelling distance to the base material 201, as explained above with reference to FIG. 8. The irradiating block 401R9 irradiates not only the area corresponding to the size of the emission surface of the irradiating block 401R9 in the base material 201, but also outside this area, being outside by a distance C (second distance) illustrated in FIG. 9 in the sub-scanning direction, with the UV rays. The distance C varies depending on the height of the emission surface and the illuminance of the irradiating unit 400, as explained above with reference to FIG. 8. For example, when the illuminance is 4.5 W/cm$^2$ (summed up to 1250 mJ/cm$^2$ in total), and the height of the emission surface of the irradiating block 401R is 2 millimeters, the distance C will be 2 millimeters.

An image forming process in the gloss-coating mode when Y<C will now be explained with reference to FIG. 10. In the example illustrated in FIG. 10, when the image forming process is to be performed in the gloss-coating mode, that is, when a gloss-coating layer is to be formed with a clear ink over an image formed with color inks, the color inks are first ejected from the head 301CM1 and the head 301YK1 in the first to fourth scans, using the head 301CM1 and the head 301YK1 as the heads 301 for forming an image by ejecting the CMYK color inks (one example of a second ejecting unit). At this time, because the color inks are irradiated with the UV rays immediately after the inks are ejected, the irradiating blocks 401R1 to 401R3, which are the irradiating blocks 401R covering the scan widths of the scans for ejecting the color inks (the first to fourth scans), are in turned-on state (emitting state). It is quite common, however, for the scan width and the length of one irradiating block 401R (the length B mentioned above) to differ, unless a special irradiation lamp matching the scan width is manufactured based on the number of scans.

The color coating film formed by ejecting color inks has an uneven finish (matte finish), because the color inks are irradiated with the UV rays immediately after the inks are ejected. The heads 301CL2, 301CL3 (one example of a first ejecting unit; one example of a specific ejecting unit) are then used as the heads 301 for ejecting the clear ink (one example of a liquid that is activation energy ray curable) with which the gloss coating is performed. At this time, because the ejection of the clear ink and the image formation with the color inks are carried out as one continuous process, the heads 301CL2, 301CL3 eject the clear ink in the same scan width as that of the scan for ejecting the color inks. The clear ink is ejected from the heads 301CL2, 301CL3 in the fifth to the twelfth scans. At that time, the irradiation control unit 603 turns off the irradiating blocks 401R4 to 401R8, which are the irradiating blocks 401R covering the scan widths of the scans for ejecting the clear ink (the fifth to the twelfth scans). In this manner, the clear ink is allowed to level sufficiently, without being irradiated with the UV rays immediately after the clear ink is ejected.

Subsequently, the UV rays for curing the clear ink having levelled sufficiently are emitted, in the thirteenth and the fourteenth scans. To achieve this end, the irradiating block 401R9, which is the irradiating block 401R covering the scan widths of the scans for irradiating the clear ink with UV rays (the thirteenth and the fourteenth scans), is brought to turned-on state (emitting state). In this manner, the clear ink, having levelled, is irradiated with the UV rays, and a gloss coating layer is formed thereby.

In the example in which Y<C illustrated in FIG. 10, however, while the clear ink ejected from the head 301CL3 should be allowed to level in the twelfth scan, a part of the range covered by the twelfth scan is irradiated with a part (protruding part) of the irradiation light emitted from the irradiating block 401R9 because Y<C. Consequently, a downstream part of the part to which the clear ink (the lower side in the sub-scanning direction in FIG. 10) is ejected, remains without being levelled sufficiently, and results in a matte finish.

To address this issue, to achieve a glossy gloss coating layer, a user moves the irradiating unit 400R in the sub-scanning direction in such a manner that Y>C is satisfied, as illustrated in FIG. 11. The user also moves the irradiating unit 400L in the same manner, in addition to the irradiating unit 400R. As a result, because the range covered by the twelfth scan is not irradiated with a part (protruding part) of the irradiation light emitted from the irradiating block 401R9, the clear ink ejected from the head 301CL3 in the twelfth scan is allowed to level sufficiently, and a glossy gloss coating layer can be formed on the color coating film.

Furthermore, in FIG. 11, because the irradiating block 401R3 is turned on in the fifth scan, an upstream part of the clear ink ejected from the head 301CL2 is cured immediately after the clear ink is ejected, and results in a matte finish. However, because the clear ink is ejected and allowed to level sufficiently in the other subsequent scans (the sixth to the twelfth scans), a glossy gloss coating layer is formed over the clear ink with a matte finish. Furthermore, because a boundary part 701 representing a boundary between one color ink ejection and another color ink ejection is covered by the irradiating block 401R3 that is turned on, the color inks are reliably irradiated with the UV rays, and therefore, a beautiful color image can be achieved.

Furthermore, as illustrated in FIG. 11, when A denotes a distance between the most upstream end of the irradiating block 401R (the irradiating unit 400) and the most upstream end of H that is the length by which the color inks are ejected in the sub-scanning direction, it is preferable to move the irradiating unit 400R in the sub-scanning direction in such a manner that A<C<Y is satisfied. By maintaining A<C, the upstream end part of the color coating film formed with the color inks ejected from the heads 301CM1, 301YK1 in the first scan is irradiated with the UV rays emitted from the irradiating block 401R1, and therefore, coalescence of one color ink with the others is suppressed, and therefore, a beautiful color image can be achieved.

In the example explained with reference to FIG. 11, the head 301CM1 and the head 301YK1 are used as the head 301 for forming an image by ejecting the CMYK color inks, and the heads 301CL2, 301CL3 are used as the heads 301 for ejecting the clear ink. However, it is also possible to use an operation mode in which the head 301W1 is used as the head 301 for ejecting the white (W) color ink, the head 301CM2 and the head 301YK2 are used as the heads 301 for ejecting the CMYK color inks, and the head 301CL3 is used as the head 301 for ejecting the clear ink, as an example of an image forming process using a white (W) color ink. In such a case, the boundary part between one color ink ejection and another color ink ejection comes to a position corresponding to the vicinity of the boundary between the irradiating block 401R5 and the irradiating block 401R6, in the example illustrated in FIG. 11. In such a case, the irradiating unit 400R (400L) is moved in the sub-scanning direction in such a manner that the boundary part is covered by the irradiating block 401R5 that is in the emitting state, within the range in which A<C<Y is satisfied, as described above. In this manner, a glossy gloss coating layer can be formed over the clear ink having a matte finish, and the color inks are reliably irradiated with the UV rays. Therefore, a beautiful color image can be achieved.

FIG. 12 is a schematic for explaining an example in which the scan width that is larger than the irradiating block width is used. An example using a scan width that is larger than the length B of one irradiating block 401R will now be explained with reference to FIG. 12. Specifically, in this example, the length of a part of one head 301 ejecting ink in the sub-scanning direction is set to a length corresponding to the two scan widths.

As illustrated in FIG. 12, when the scan width is larger than the length B of one irradiating block 401R, even if the irradiating block 401R9 is caused to emit UV rays in the last seventh scan, a part of the ejected clear ink remains without being irradiated, and such a part of the clear ink remains uncured, because the adjacent irradiating block 401R8 is turned off. Therefore, in order to achieve a gloss coating layer that is sufficiently cured, it is desirable to use a scan width that is smaller than the length B of one irradiating block 401R.

(Sequence of Image Forming Process Performed by Image Forming Apparatus)

FIG. 13 is a flowchart illustrating one example of the sequence of an image forming process (including a curing process) performed by the image forming apparatus according to the embodiment. The sequence of the image forming process performed by the image forming apparatus 1 in the gloss-coating mode according to the embodiment will now be explained with reference to FIG. 13. FIG. 13 will be explained focusing on the irradiating unit 400R, but the same process applies to the irradiating unit 400L. Furthermore, in the explanation of FIG. 13, it is assumed that the head 301CM1 and the head 301YK1 are used as the heads 301 for forming an image by ejecting CMYK color inks, and the heads 301CL2, 301CL3 are used as the heads 301 for ejecting the clear ink for the gloss coating, in the same manner as in the example explained above with reference to FIG. 11. Furthermore, in FIG. 13, an image forming operation will be explained focusing on a specific part of the base material 201 (an area corresponding to one scan width).

<Step S11>

A user removes the lamp fixing pin 405R that is attached to the lamp moving mechanism 402 and the lamp fixing mechanism 403, and moves the irradiating unit 400R in the sub-scanning direction in such a manner that A<C<Y is satisfied. After moving the irradiating unit 400R, the user fixes the irradiating unit 400R to the lamp fixing mechanism 403 by fitting the lamp fixing pin 405R into the lamp moving mechanism 402 and the lamp fixing mechanism 403. The process is then shifted to Step S12.

<Step S12>

The droplet ejection control unit 602 specifies the heads 301 that are positioned upstream as heads for ejecting color inks, and specifies the head 301 positioned downstream as a head for ejecting the clear ink, among the heads 301 that are arranged in the sub-scanning direction. The irradiation control unit 603 then brings the irradiating blocks 401R covering the scan widths of the scans for ejecting the color ink to turned-on (emitting state). The irradiation control unit 603 also turns off the irradiating blocks 401R covering the scan widths of the scans for ejecting the clear ink. The movement control unit 601 then starts repeating the operation of scanning the main scanning unit 100 in the main-scanning direction and the operation of moving the sub-scanning unit 200 in the sub-scanning direction. In the explanation herein, it is assumed that, in the same manner as the example illustrated in FIG. 11, the head 301CM1 and the head 301YK1 are specified as the heads 301 for ejecting the color inks positioned upstream, and the heads 301CL2, 301CL3 are specified as the head 301 for ejecting the clear ink positioned downstream. The process is then shifted to Step S13.

<Step S13>

If the next scanning operation to be performed by the main scanning unit 100 is a scan for ejecting a color ink (Yes at Step S13), the process is shifted to Step S14. If the operation is not a scan for ejecting a color ink (No at Step S13), the process is shifted to Step S16. In the example illustrated in FIG. 11, the first to fourth scans correspond to the scans for ejecting a color ink.

<Step S14>

The droplet ejection control unit 602 forms a color image by causing the head 301CM1 and the head 301YK1 to eject the color inks onto the base material 201, in synchronization with the operation of scanning the main scanning unit 100, achieved by the movement control unit 601. The process is then shifted to Step S15.

<Step S15>

Immediately after the droplet ejection control unit 602 has caused the color inks to be ejected, the irradiation control unit 603 cures the color ink by causing the irradiating block 401R corresponding to this scan and having been turned on to irradiate the color coating film, formed with the color inks, with UV rays. Instead of the irradiation control unit 603 performing the operation of turning on the irradiating block 401R, the irradiating block 401R may be always turned on, or may be turned on at the timing at which the irradiating block 401R is scanned over a color ink that is to be cured. The process is then shifted to Step S20.

<Step S16>

If the next scanning operation to be performed by the main scanning unit 100 is a scan for ejecting clear ink (Yes at Step S16), the process is shifted to Step S17. If the operation is not a scan for ejecting clear ink (No at Step S16), the process is shifted to Step S19. In the example illustrated in FIG. 11, the fifth to the twelfth scans correspond to the scan for ejecting the clear ink, and the thirteenth and the fourteenth scans correspond to scans for ejecting neither the color ink nor the clear ink (scans for emitting the UV rays).

<Step S17>

The droplet ejection control unit 602 causes one of the head 301CL2 and the head 301CL3, whichever corresponds to the scan, to eject the clear ink onto the base material 201, in a manner synchronized with the scanning operation of the main scanning unit 100, achieved by the movement control unit 601. The process is then shifted to Step S18.

<Step S18>

Immediately after the droplet ejection control unit 602 causes the clear ink to be ejected, the clear ink is allowed to level (smooth out), without being irradiated with the UV rays, because the irradiation control unit 603 keeps the irradiating block 401R corresponding to this scan in turned-off state. The process is then shifted to Step S20.

<Step S19>

If the scan is not a scan for ejecting the color ink or the clear ink, but is a scan at the final stage (the thirteenth scan and the fourteenth scan in the example illustrated in FIG. 11), the clear ink has already been ejected over the color coating film, and has been allowed to level. Therefore, the irradiation control unit 603 cures the clear ink by causing the irradiating block 401R corresponding to this scan and having been turned on to irradiate the clear ink with the UV rays. The process is then shifted to Step S20.

<Step S20>

If the final scanning operation has been completed (Yes at Step S20), the image forming process is ended. If the final scanning operation has not been completed yet (No at Step S20), the movement control unit 601 moves the base material 201 by one scan width in the sub-scanning direction, and the process is returned to Step S13.

Through the operations at Steps S11 to S20 described above, the image forming process in the gloss-coating mode is executed.

As described above, in the image forming apparatus 1 according to the embodiment, the irradiating unit 400R (400L) is moved in the sub-scanning direction in such a manner that Y>C is satisfied. Therefore, in the most downstream scan in which the clear ink is ejected, it is possible to allow the clear ink ejected by the most downstream head 301 to level sufficiently, because the range covered by the scan is not irradiated with a part of the irradiation rays (protruding part) for curing the clear ink emitted from the irradiating block 401R (401L). Hence, a glossy gloss coating layer can be formed over a color coating film at a lower cost.

In the image forming apparatus 1 according to the embodiment, the irradiating unit 400R is moved in the sub-scanning direction in such a manner that A<C<Y is satisfied, when A denotes the length (third distance) between the most upstream end of the irradiating block 401R (401L) and the most upstream end of H that is the length by which the color inks are ejected in the sub-scanning direction. By maintaining A<C, the upstream end part of the color coating film, which is achieved by the color ink ejected by the head 301 in the first scan, is also irradiated with the UV rays from the most upstream irradiating block 401R (401L). Therefore, coalescence of one color ink with the others is suppressed, and a beautiful color image can be achieved.

Furthermore, if the boundary part between the irradiating blocks is at a position corresponding to vicinity of the boundary between one color ink ejection and another color ink ejection, the irradiating unit 400R (400L) is moved in the sub-scanning direction in such a manner that the boundary part is covered by the irradiating block that is in the emitting state, among the irradiating blocks provided, within the range in which A<C<Y is satisfied, as described above. In this manner, a glossy gloss coating layer can be formed over a clear ink with a matte finish, and the color inks are reliably irradiated with the UV rays. Therefore, a beautiful color image can be achieved.

Furthermore, in the image forming apparatus 1 according to the embodiment, the scan width is set smaller than the length B of one irradiating block 401R (401L). As a result, it is possible to avoid a situation in which a part of the ejected clear ink remains without being irradiated, and the clear ink remains uncured in some area, for a reason that, although the irradiating block 401R (401L) is configured to emit UV rays in the last scan, the irradiating block 401R (401L) adjacent thereto is configured to be turned off. Therefore, a sufficiently cured gloss coating layer can be achieved.

(Modification)

FIG. 14 is a schematic illustrating one example of positioning of an irradiating unit in an image forming apparatus according to a modification. This image forming apparatus 1 according to a modification of the embodiment will now be explained with reference to FIG. 14.

As illustrated in FIG. 14, in the main scanning unit 100 provided to the image forming apparatus 1 according to the modification, the irradiating unit 400R is mounted in such a manner that the emission surface of the irradiating unit 400R is tilted with respect to the top surface of the base material 201 in the sub-scanning direction. Furthermore, the irradiating unit 400R is mounted in such a manner that a downstream part of the emission surface of the irradiating unit 400R in the sub-scanning direction is positioned higher. The irradiating unit 400L is mounted in the same manner as the irradiating unit 400R.

In this manner, by tilting the emission surface of the irradiating unit 400R (400L) with respect to the top surface of the base material 201 in the sub-scanning direction, the travelling distance is extended so that the irradiation range broadens. Therefore, even if the length L of the irradiating unit 400R (400L) in the sub-scanning direction is short, a partial irradiation with the irradiating block 401R (401L) is achieved.

Furthermore, by tilting in such a manner that a downstream part of the emission surface of the irradiating unit 400R in the sub-scanning direction is positioned higher, the UV rays having a lower illuminance is emitted from the leftmost irradiating block, in the view facing the paper surface in FIG. 14, in the scan for curing the clear ink. In this manner, the cure shrinkage does not vary very much within the clear ink, so that a beautiful gloss coating film can be achieved.

Furthermore, in the embodiment and the modification described above, when at least one of the functional units of the image forming apparatus 1 is implemented by execution of a computer program, the computer program is provided in a manner incorporated in the ROM or the like in advance. Furthermore, the computer program executed by the image forming apparatus 1 according to the embodiment and the modification described above may be provided in a manner recorded in a computer-readable recording medium such as a compact disc read-only memory (CD-ROM), a flexible disk (FD), a compact disc recordable (CD-R), and a digital versatile disc (DVD), as a file in an installable or executable format. Furthermore, the computer program executed by the image forming apparatus 1 according to the embodiment and the modification described above may be stored in a computer connected to a network such as the Internet, and made available for download over the network. Furthermore, the computer program executed by the image forming apparatus 1 according to the embodiment and the modification described above may be provided or distributed over a network such as the Internet. Furthermore, the computer program executed by the image forming apparatus 1 according to the embodiment and the modification described above has a modular structure including at least one of the functional units described above, and, as actual hardware, by causing the CPU 34 to read the computer program from the storage device (e.g., the ROM 32) and to execute the computer program, the functional units described above are loaded to and generated on the main memory (e.g., the memory 33).

REFERENCE SIGNS LIST

1 Image forming apparatus
2 PC
3 Controller unit
4 Detector group
31 Unit control circuit
32 ROM
33 Memory
34 CPU
35 I/F
41 Height sensor
100 Main scanning unit
101 Timing belt
200 Sub-scanning unit
201 Base material
300 Head unit
301 Head
301C1 to 301C3 Ejecting unit
301CL1 to 301CL3 Head
301CM1 to 301CM3 Head
301K1 to 301K3 Ejecting unit
301M1 to 301M3 Ejecting unit
301W1 to 301W3 Head
301Y1 to 301Y3 Ejecting unit
301YK1 to 301YK3 Head
400 Irradiating unit
400L Irradiating unit
400R Irradiating unit
401L, 401L1 to 401L9 Irradiating block
401R, 401R1 to 401R9 Irradiating block
402 Lamp moving mechanism
403 Lamp fixing mechanism
404 Guide rail
405L, 405R Lamp fixing pin
500 Maintenance unit
501 Wiper unit
601 Movement control unit
602 Droplet ejection control unit
603 Irradiation control unit
701 Boundary part
L1 Irradiation width
Lh Irradiation width

CITATION LIST

Patent Literature

[PTL 1]

Japanese Laid-open Patent Publication No. 2015-186918

The invention claimed is:

1. An ejecting apparatus comprising:

an ejection control unit configured to cause a first ejecting unit among ejecting units configured to move in a main-scanning direction, to eject a liquid that is activation energy ray curable, to a recording medium;

an irradiating unit configured to emit an activation energy ray and divided into a plurality of irradiating blocks in a sub-scanning direction perpendicular to the main-scanning direction; and an irradiation control unit configured to selectively turn off an irradiating block corresponding to the first ejecting unit moving in the main-scanning direction, among the plurality of irradiating blocks in the event that the first ejecting unit ejects a liquid that is clear ink, wherein the irradiating unit is configured to be movable relative to the first ejecting unit during printing, and is positioned in such a manner that a first distance is larger than a second distance, the first distance being a distance between a downstream end of the first ejecting unit in the sub-scanning direction and an upstream end of an irradiating block that is positioned downstream among the plurality of irradiating blocks, the second distance being a distance by which the irradiating block irradiates the recording medium outside from an end of an emission surface of the irradiator block in the sub-scanning direction, wherein the irradiation control unit is configured to cure the liquid by causing the irradiating block positioned downstream of the turned-off irradiating block corresponding to the first ejecting unit in the sub-scanning direction, to emit the activation energy ray.

2. The ejecting apparatus according to claim 1, wherein the ejection control unit is configured to cause a second ejecting unit that is positioned upstream of the first ejecting unit, among the ejecting units, to eject a colored liquid that is activation energy ray curable, and the irradiation control unit is configured to cause the irradiating block corresponding to the second ejecting unit moving in the main-scanning direction, among the plurality of irradiating blocks, to emit the activation energy ray to cure the colored liquid.

3. The ejecting apparatus according to claim 2, wherein the irradiating unit is positioned in such a manner that a third distance is smaller than the second distance, the third distance being a distance between an upstream end of the second ejecting unit in the sub-scanning direction and an upstream end of an irradiating block positioned most upstream, among the plurality of irradiating blocks.

4. The ejecting apparatus according to claim 2, wherein the irradiation control unit is configured to cause an irradiating block corresponding to a boundary between the first ejecting unit and the second ejecting unit in the main-scanning direction, to emit the activation energy ray.

5. The ejecting apparatus according to claim 1, wherein a scan width when the ejecting units perform scanning in the main-scanning direction is smaller than a length of the irradiating block in the sub-scanning direction.

6. The ejecting apparatus according to claim 1, wherein the irradiating unit is positioned in such a manner that an emission surface of the irradiating unit is tilted with respect to the recording medium in the sub-scanning direction.

7. The ejecting apparatus according to claim 6, wherein the irradiating unit is positioned in such a manner that a downstream part of the emission surface in the sub-scanning direction is positioned higher than an upstream part, with respect to the recording medium.

8. An image forming apparatus comprising:

the ejecting units;

a movement control unit configured to move the ejecting units in the main-scanning direction; and the ejecting apparatus according to claim 1.

9. The image forming apparatus according to claim 8, further comprising an irradiation moving unit configured to allow the irradiating unit to move with respect to the ejecting units in the sub-scanning direction.

10. A curing method comprising:

causing a specific ejecting unit among ejecting units configured to move in a main-scanning direction with respect to a recording medium, to eject a liquid that is activation energy ray curable;

selectively turning off an irradiating block moving in the main-scanning direction in the event that the specific ejecting unit ejects a liquid that is clear ink, the irradiating block being an irradiating block corresponding to the specific ejecting unit, among a plurality of irradiating blocks of an irradiating unit that is configured to emit an activation energy ray, that is divided into the plurality of irradiating blocks in a sub-scanning direction perpendicular to the main-scanning direction, that is configured to be movable relative to the specific ejecting unit during printing, and that is positioned in such a manner that a first distance is larger than a second distance, the first distance being a distance between a downstream end of the specific ejecting unit in the sub-scanning direction and an upstream end of an irradiating block positioned downstream among the plurality of irradiating blocks, the second distance being a distance by which the irradiating block irradiates the recording medium outside from an end of an emission surface of the irradiator block in the sub-scanning direction, and curing the liquid by causing the irradiating block positioned downstream of the turned-off irradiating block corresponding to the specific ejecting unit in the sub-scanning direction, to emit the activation energy ray.

11. A non-transitory computer-readable medium including programmed instructions that cause a computer to execute:

causing a specific ejecting unit among ejecting units configured to move in a main-scanning direction with respect to a recording medium, to eject a liquid that is activation energy ray curable;

selectively turning off an irradiating block moving in the main-scanning direction in the event that the specific ejecting unit ejects a liquid that is clear ink, the irradiating block being an irradiating block corresponding to the specific ejecting unit, among a plurality of irradiating blocks of an irradiating unit that is configured to emit an activation energy ray, that is divided into the plurality of irradiating blocks in a sub-scanning direction perpendicular to the main-scanning direction, that is configured to be movable relative to the specific ejecting unit during printing, and that is positioned in such a manner that a first distance is larger than a second distance, the first distance being a distance between a downstream end of the specific ejecting unit in the sub-scanning direction and an upstream end of an irradiating block positioned downstream among the plurality of irradiating blocks, the second distance being a distance by which the irradiating block irradiates the recording medium outside from an end of an emission surface of the irradiator block in the sub-scanning direction, and curing the liquid by causing the irradiating block positioned downstream of the turned-off irradiating block corresponding to the specific ejecting unit in the sub-scanning direction, to emit the activation energy ray.

* * * * *